US005901722A

United States Patent [19]

Lee

[11] Patent Number: 5,901,722

[45] Date of Patent: May 11, 1999

[54] SUNSHADE

[76] Inventor: Chorng-Cheng Lee, No. 6, Lane 224, Wu Feng South Road, Chia Yi, Taiwan

[21] Appl. No.: 09/089,226

[22] Filed: Jun. 3, 1998

[51] Int. Cl.[6] ..... A45B 25/00

[52] U.S. Cl. ..... 135/25.1; 135/33.2; 135/33.6

[58] Field of Search ..... 135/25.1, 25.31, 135/25.32, 25.33, 29, 31, 33.6, 25.4, 33.2

[56] References Cited

U.S. PATENT DOCUMENTS

| | | | |
|---|---|---|---|
| 912,206 | 2/1909 | Thayer | 135/25.32 |
| 1,042,174 | 10/1912 | Tyminski | 135/25.31 |
| 1,063,989 | 6/1913 | McCabe | 135/22 |
| 1,096,216 | 5/1914 | Beehler | 135/74 |
| 1,473,906 | 11/1923 | Hartzell | 135/25.32 |
| 1,908,453 | 5/1933 | Schmidt | 135/25.31 X |
| 3,217,723 | 11/1965 | Schy | 135/15.1 X |
| 3,457,931 | 7/1969 | Shimizu | 135/25.33 X |
| 4,986,294 | 1/1991 | Wu | 135/22 |
| 5,482,069 | 1/1996 | Lee | 135/31 |

*Primary Examiner*—Lanna Mai
*Assistant Examiner*—Timothy B. Kang
*Attorney, Agent, or Firm*—Rosenberg, Klein & Bilker

[57] ABSTRACT

A sunshade includes a securing ring fixed on an upper end of a metal rod, a plurality of ribs pivotally connected to the securing ring and tied with a circumferential edge of a sunshade cloth, and each stretcher having two ends respectively connected pivotally to an intermediate portion of each rib and a runner, which is movably fixed around the metal rod. The metal rod has a hole in an upper end portion for a spring and a top rod on the spring to fit therein. The top rod has female threads for screwing with a bolt to secure the center of the sunshade cloth.

1 Claim, 6 Drawing Sheets

SUNSHADE

BACKGROUND OF THE INVENTION

This invention relates to a sunshade, particularly to one provided with a top rod pushed by a spring to cause a pulling force between the center of the sunshade and plural ribs for spreading the sunshade smoothly.

A known conventional sunshade shown in

FIG. 6 includes a metal rod 10, a secure ring 30, a plurality of ribs 20 pivotaly connected to the secure ring 30, a plurality of stretchers 40 pivotally connected to the related ribs 20, a runner 50 movably fitted around the metal rod 10 and piovatally connected to inner ends of the stretchers 40, and an upper stop 101 located between the secure ring 30 and the runner 50. Then the runner 50 is pushed upward to spread the sunshade, and the upper stop 101 stops the runner 50 after passing up the stop 101, preventing the runner 50 from moving down and keeping the sunshade in the spread position.

If the sunshade is wanted to be collapsed from the spread position, the upper stop 101 is pressed down inside the metal rod 10, permitting the runner 50 move down to its original collapsed position. However, when the stop 101 is pressed down and the runner 50 slides down, a finger or a hand of a user is liable to be pinched between the stop 101 and the runner 50, very inconvenient.

Another known conventional sunshade shown in FIG. 7 includes a metal rod 10, a manual winder 70 fixed on a lower portion of the metal rod 10 for spreading and collapsing the sunshades,roller 102 provided on a metal rod 10 and passing through by a string 701 wound around the winder 70, and two ends of the string 701 fixed on the runner 50. When a swing rod of the winder 70 is handled, the string 701 is pulled to move the runner 50 upward, pulling the ribs 20 upward to the spread position. If the sunshade is wanted to be collapsed, then winder 70 is operated to move the runner 50 down to its original collapsed position. But this conventional sunshade is rather complicated in its structure in spreading and collapsing.

SUMMARY OF THE INVENTION

This invention has been devised to offer a sunshade, which has a coil spring urging a top rod on a metal rod, with the top rod protruding up the center of a sunshade cloth. Then A bolt screws with the top rod to press the center of the sunshade cloth, and the circumferential edge of the sunshade cloth is bound on outer ends of a plurality of ribs. A plurality of stretchers have inner ends pivotally connected to a runner movably fixed around the metal rod and outer ends thereof pivotally connected to intermediate portions of all the ribs. When the runner is pushed to slide up, with the stretchers pushing outward the ribs, and with the coil spring pressing the center of the sunshade cloth and a pulling force formed between the sunshade cloth and the ribs to spread the sunshade smoothly.

BRIEF DESCRIPTION OF DRAWINGS

The invention will be better understood by referrring to the accompanying drawings, wherein.

DETAILED DESCRIPTION OF THE PREFERRED EMBODIMENTS

Figure 1:
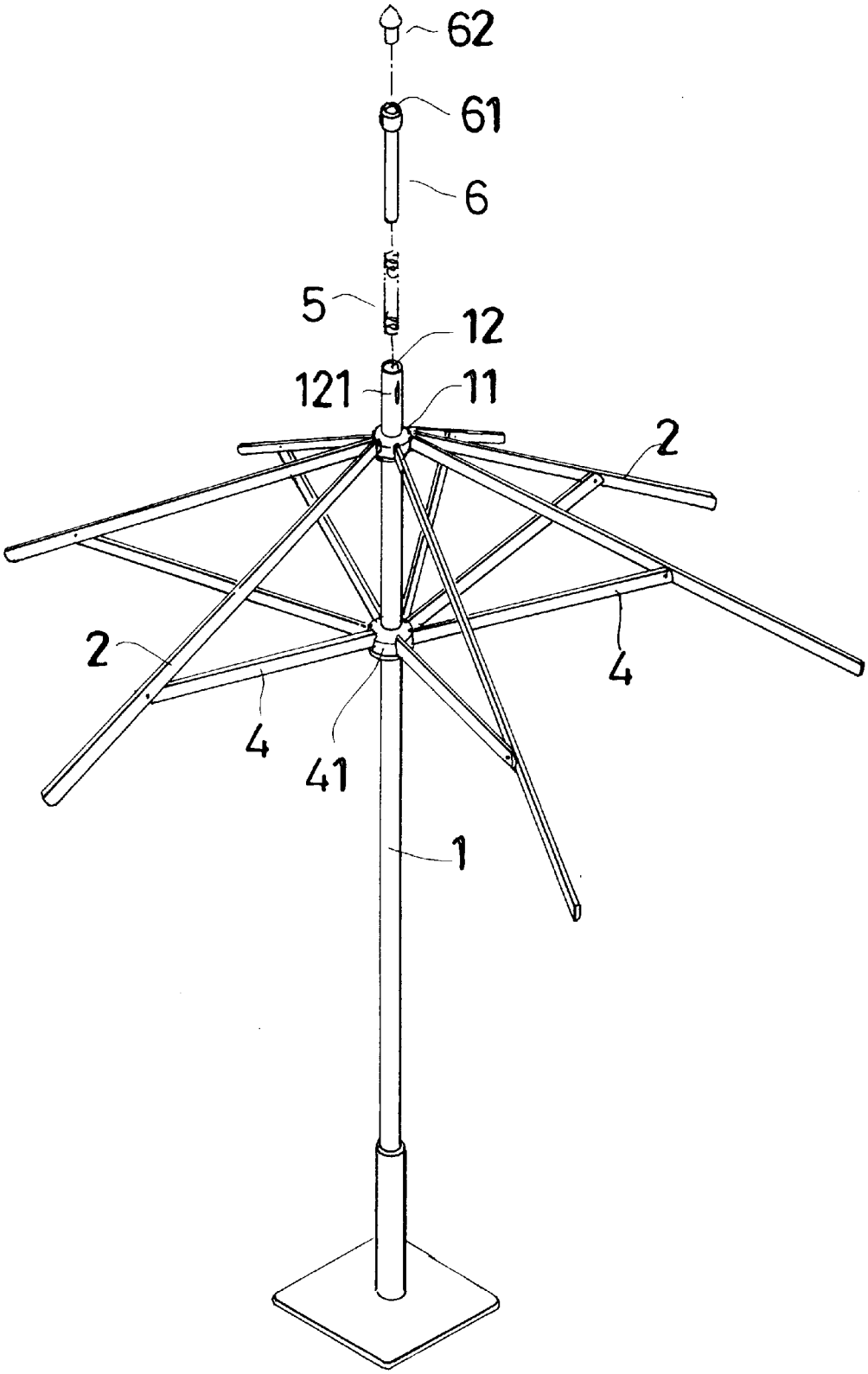
FIG. 1 is an exploded perspective view of a first preferred embodiment of a sunshade of the present invention.
Figure 2:
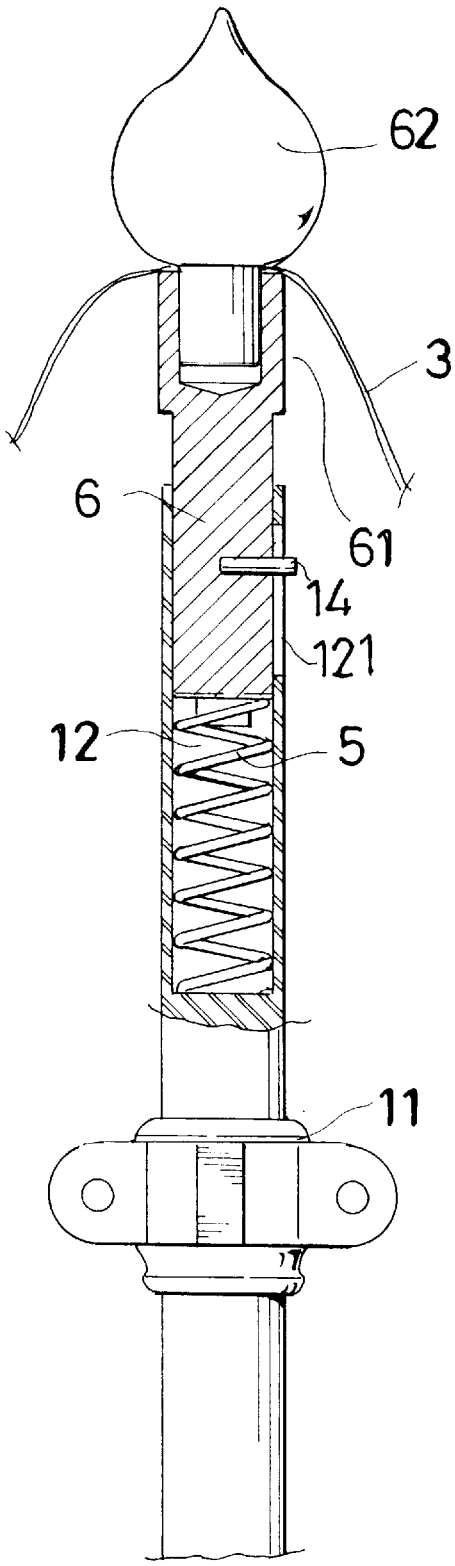
FIG. 2 is a partial enlarged cross-sectional view of the first preferred embodiment of a sunshade of the present invention.
Figure 4:
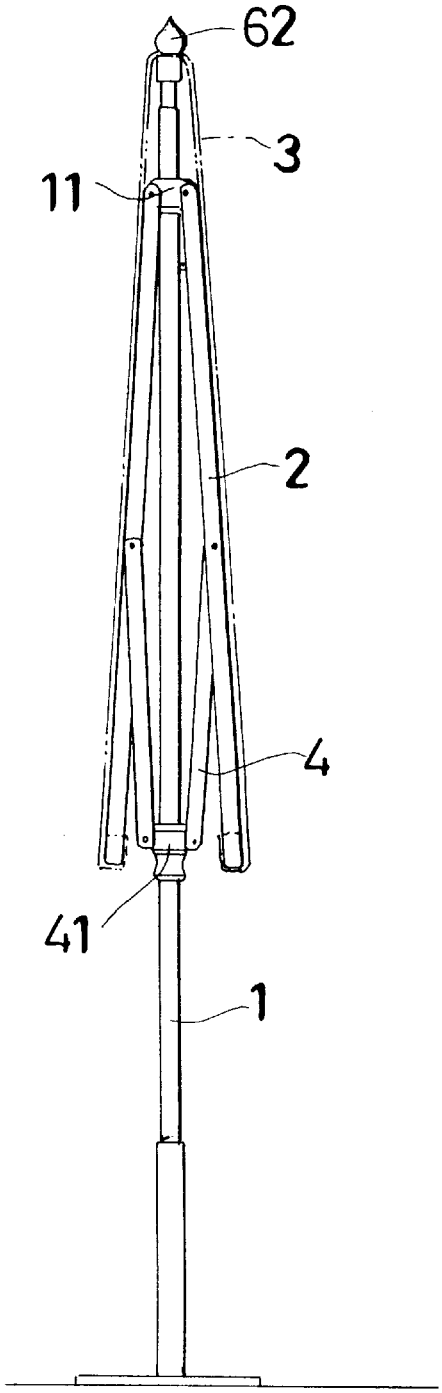
FIG. 4 is a perspective view of the first preferred embodiment of a sunshade of the present invention, showing it being in the collapsed position.

A first preferred embodiment of a sunshade in the present invention, as shown in FIGS. 1 and 2, includes a metal rod 1, and upper securing ring 11, a plurality of ribs 2, a plurality of stretchers 4, a runner 41 fitted movably around the metal rod 1, a coil spring 5, and a top rod 6 as main components combined together.

The securing ring 11 is fixed firmly on an upper end of the metal rod 1, and inner ends of the ribs 2 are pivotally connected to the securing ring 11.

The ribs 2 have the inner ends pivotally connected to the securing ring 11, and the outer ends tied with a circumferential edge of a sunshade cloth 3.

The stretchers 4 have the inner ends pivotally connected to the runner 41 and the outer ends pivotally connected to the intermediate portions of the ribs 2.

The metal rod 1 has its upper end surface provided with a hole 12 and a slot 121 in the wall defining the hole 12. Then the coil spring 5 and a top rod 6 on the spring 5 are contained in the hole 12. Further, a pin 14 is provided, passing through the slot 121 and sticking in the top rod 6 to prevent the top rod 6 and the coil spring 5 from falling out of the hole 12. Further, the top rod 6 has female threads in the top for a bolt 62 to engage to secure the center of the sunshade cloth 3 in its position after the center of the sunshade cloth 3 is inserted through by the bolt 62.

Figure 3:
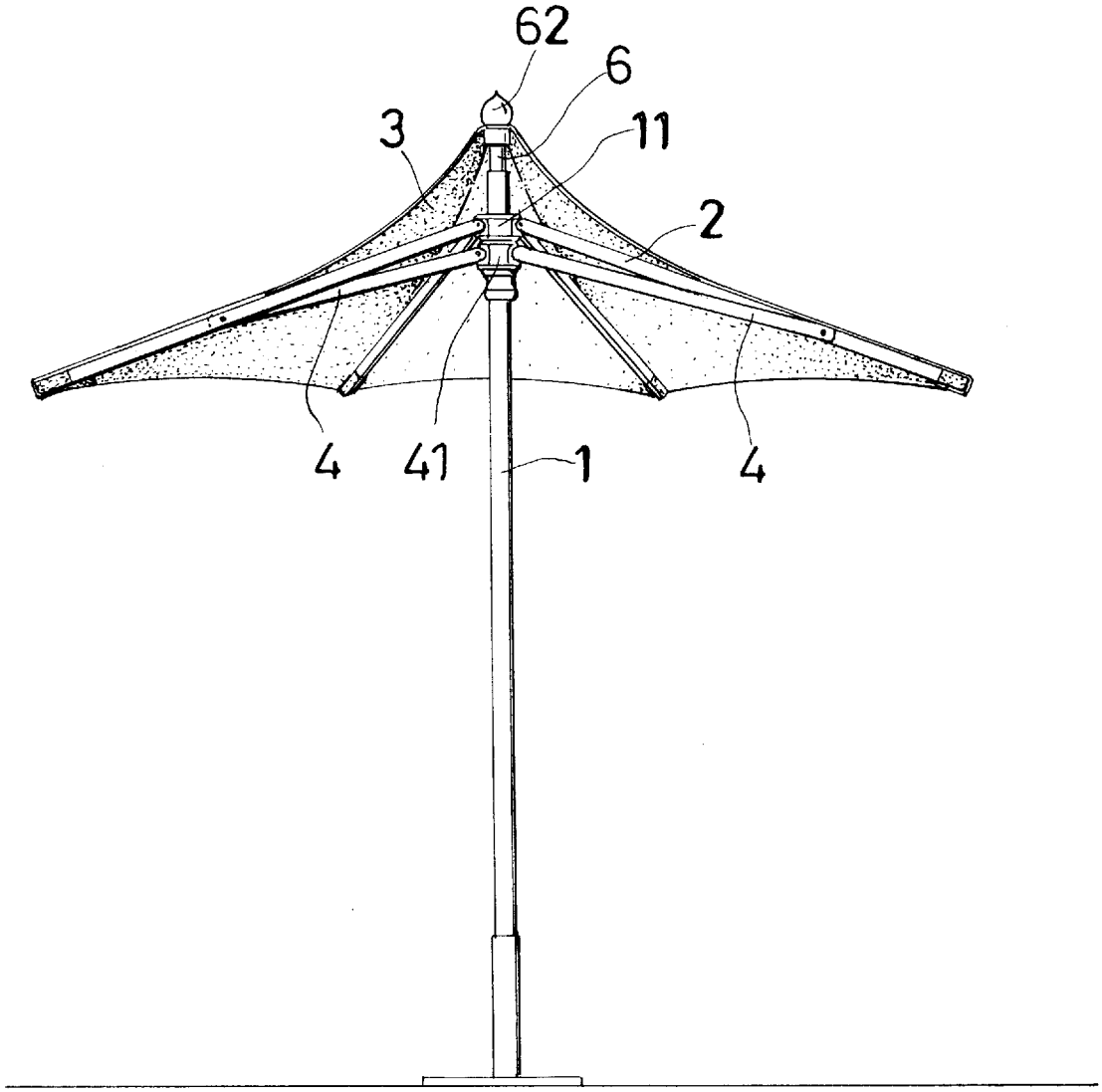
FIG. 3 is a side view of the first preferred embodiment of a sunshade of the present invention, showing it being in the spread position.

In using the sunshade in the invention, the runner 41 is pushed forcefully to slide up along the metal rod 1 until the runner 41 is stopped by the securing ring 11, with the angle between the stretchers 4 and the metal rod 1 gradually increased to a little larger angle than the right angle, with the stretchers 4 pushing the ribs outward to the horizontal position, wherein the runner 41 contacts the securing ring 11 in a stabilized condition, as shown in FIG. 3. Meanwhile, the center of the sunshade cloth 3 is elastically pressed by the coil spring 5. If the sunshade is wanted to be collapsed, pushing forcefully down the runner 41 can effect the purpose.

In the spread position of the sunshade, the runner 41 can no longer moved up stopped by the securing ring 11, with the ribs 2 having their outer ends firmly pushing the circumferential edge of the sunshade cloth 3, which has its center pressed by the top rod 6 elastically pushed by the coil spring 5, unable to be collapsed without intention. In other words, the runner 41 has to be pushed up or down with a force larger than the elasticity of the coil spring 5 for spreading or collapsing the sunshade so as to pass over the right-angle position of the stretchers 4 relative to the metal rod 1.

In case that the sunshade in the invention is to be applied to a large size, a stopper 13 may be further provided between the runner 41 and the securing ring 11 on the metal rod 1 for limiting the runner 41 in moving up.

Figure 5:
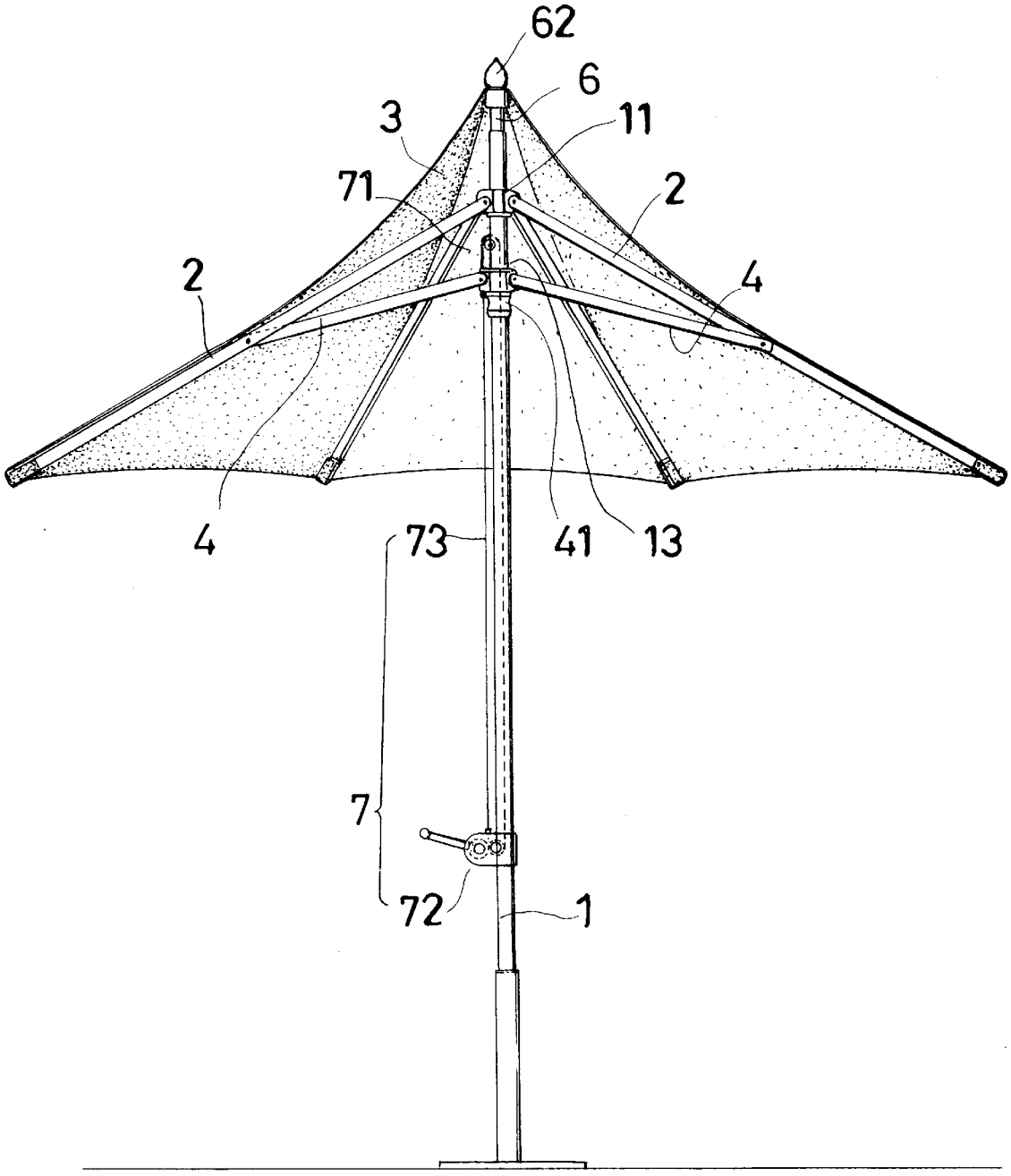
FIG. 5 is a side view of a second preferred embodiment of a sunshade of the present invention.
Figure 6:
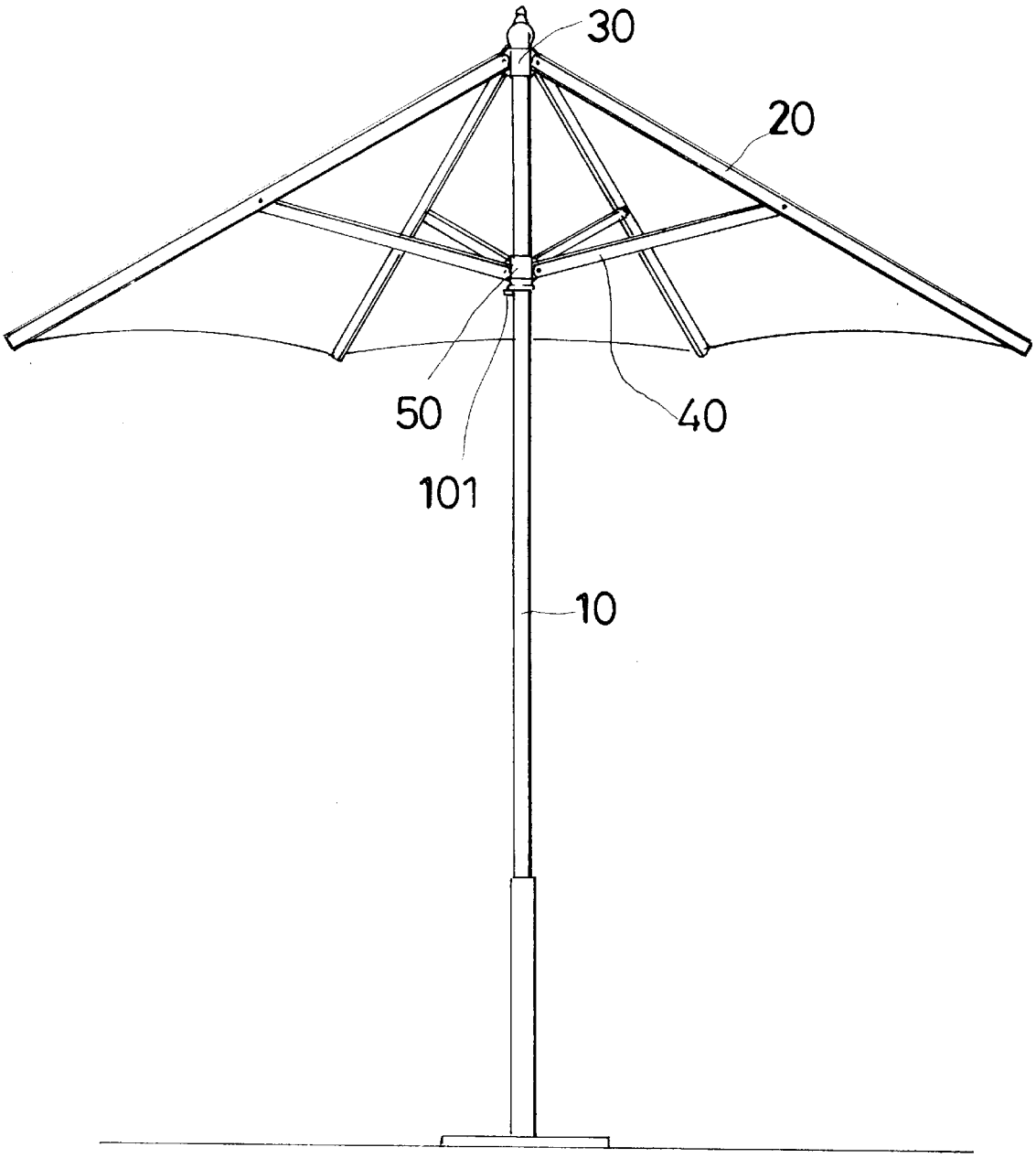
FIG. 6 (PRIOR ART)
FIG. 6 is a side view of a first conventional sunshade.
Figure 7:
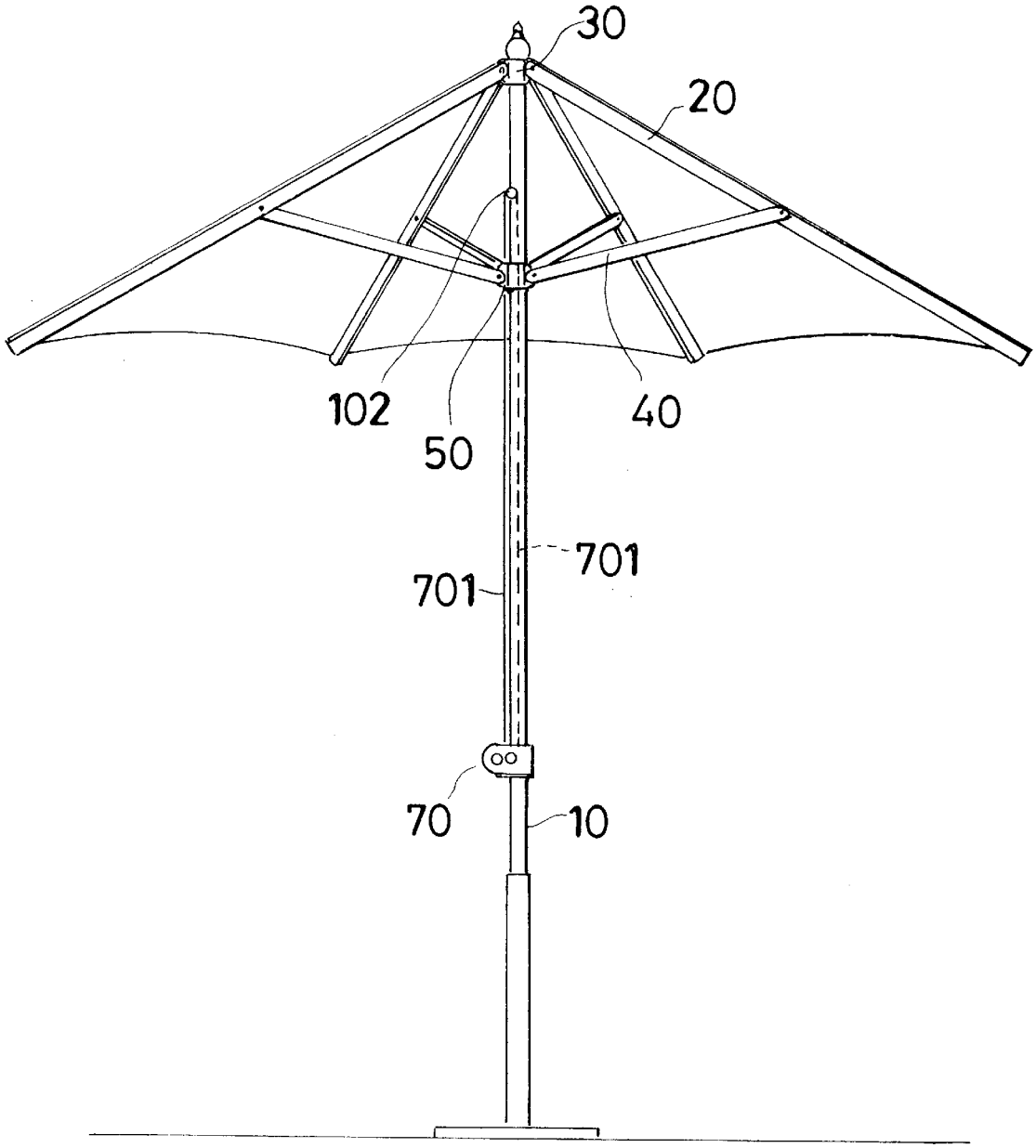
FIG. 7 (PRIOR ART)
FIG. 7 is a side view of a second conventional sunshade.

A second preferred embodiment of the invention is shown in FIG. 5, additionally provided with a winder 7, wherein a roller 71 disposed between the securing ring 11 and the runner 41, a winding mechanism 72 fixed on a lower portion of the metal rod 1, a string 73 winding the roller 71 and the winding mechanism 72 and having two ends firmly bound on the runner 41. Then the sunshade may be spread or collapsed by means of the winding mechanism 72.

While the preferred embodiments of the invention have been described above, it will be recognized and understood that various modifications may be made therein and the appended claims are intended to cover all such modifications which may fall within the spirit and scope of the invention.

What is claimed is:

1. A sunshade comprising a metal rod, a securing ring fixed firmly on an upper end of said metal rod, a plurality of ribs having inner ends pivotally connected to said securing ring and outer ends tied firmly with a circumferential edge of a sunshade cloth, a plurality of stretchers having inner ends pivotally connected to a runner mounted around said metal rod and outer ends pivotally connected to intermediate portions of said ribs; and, characterized by said metal rod having a center hole formed in an upper end, a coil spring and a top rod mounted on top of said coil spring being contained in said center hole, said top rod having female threads formed in its top end for a bolt to screw with to secure the center of said sunshade cloth, the center of said sunshade cloth being pushed upward by said coil spring and in the circumferential edge of said sunshade pushed outward by said ribs when said runner is pushed up to force said stretchers to a spread position whereby said runner is unable to slide down and maintains said sunshade in the spread position in a stable manner, without providing a spring stop for preventing said runner from sliding down after said runner is moved to the spread position.

* * * * *